US005768736A

United States Patent [19]

Preston

[11] Patent Number: 5,768,736

[45] Date of Patent: Jun. 23, 1998

[54] MOP HEAD AND HOLDING MEANS

[76] Inventor: Renee Preston, 1813 S. Hull St., F-1, Montgomery, Ala. 36104

[21] Appl. No.: 531,104

[22] Filed: Sep. 20, 1995

[51] Int. Cl.[6] ..... A47L 13/24

[52] U.S. Cl. ..... 15/147.1; 15/229.1; 15/229.2; 15/228

[58] Field of Search ..... 15/147.1, 115, 15/150, 151, 152, 153, 154, 229.1, 229.2, 228, 226, 147.2, 116.1, 116.2, 119.1, 119.2

[56] References Cited

U.S. PATENT DOCUMENTS

| | | | |
|---|---|---|---|
| 46,290 | 2/1865 | Ball | 15/147.1 |
| 1,811,336 | 6/1931 | Spino | 15/147.1 |
| 2,242,869 | 5/1941 | Phipps | 15/147.1 |
| 2,264,736 | 12/1941 | Baker | 15/147.2 |
| 2,280,556 | 4/1942 | Stromgren | 15/147.1 |
| 2,368,037 | 1/1945 | Osborne et al. | 15/151 |
| 2,743,471 | 5/1956 | Forrester | 15/228 |
| 3,246,356 | 4/1966 | Sorrells | 15/150 |
| 4,135,272 | 1/1979 | Stephenson | 15/147.1 |
| 4,417,364 | 11/1983 | Hammond | 15/147.1 |
| 4,675,932 | 6/1987 | Hofacker, Jr. | 15/229.2 |
| 4,995,134 | 2/1991 | Monahan | 15/147.1 |
| 5,088,148 | 2/1992 | Hernandez | 15/147.1 |

FOREIGN PATENT DOCUMENTS

| | | | |
|---|---|---|---|
| 444067 | 3/1936 | United Kingdom | 15/147.1 |
| 2098122 | 11/1982 | United Kingdom | 15/147.1 |

*Primary Examiner*—Gary K. Graham

[57] ABSTRACT

A modified mop head and a handle for holding the mop head is described. The invention comprises a mop handle which has a flexible tubular band with at least one open end. The invention further comprises a mop head which is curved, also has at least one open end and is of substantially slightly larger size than the interior size of the tubular band so that when the mop head is placed within the tubular band it flexes the tubular band and is then held by the action of the tubular band attempting to go back to its pre-flexed position.

13 Claims, 6 Drawing Sheets

MOP HEAD AND HOLDING MEANS

BACKGROUND OF INVENTION

1. Prior Art

This invention applies to mops and mop handles.

2. RELATED ART

The prior art shows existence of mops and mop handles. Some mops have scrubbing surfaces and some have removable mop heads.

GENERAL DESCRIPTION OF THE INVENTION

A modified mop head and a handle for holding the mop head is described. The invention comprises a mop handle which has a flexible tubular band with at least one open end. The invention further comprises a mop head which is curved, also has at least one open end and is of substantially slightly larger size than the interior size of the tubular band so that when the mop head is placed within the tubular band it flexes the tubular band and is then held by the action of the tubular band attempting to go back to its pre-flexed position.

The mop head outer circumference may be slightly shorter than the walls of the outer circumference of the tubular band so that the uppermost walls of the tubular band close slightly over the mop head, although this is not present in the preferred embodiment. In the preferred embodiment, the tubular band and mop head have an approximately common top surface. The curve of the outer walls of the mop head and tubular band may be slightly greater from side to side than 270 degrees so that a slight curve inward on both is present. As can be seen by this description, only one of the two major components, the tubular band or mop head need be flexible to allow for the operation of the invention. However, in the preferred embodiment, both are flexible, enhancing the action of the seal between these two elements.

A male member and female member are provided on the mop head and tubular band which cooperate to prevent, under ordinary forces, the mop head from moving relative to the tubular band. The mop head is otherwise improved in that it has a band which holds the mop bristles in place. This band has two locks on one side of differing lengths. A first lock is put in place over the yarns, bristles or rags of the mop which is looser than the second. The yarns are then spread out and the band is tightened using the second lock. The band locks on either side using locks of this type. An added improvement possible with this mechanism is the addition of a scrub brush which is preferably outside of the mop yarn which is held by the same band or by a separate band provided for this purpose.

The mop head is curved on the outside but flat on the inside. This flat inner diameter is to allow the yarns of the mop to be inserted more easily. The sides need only be flat, the bottom may be curved to reduce the amount of plastic used. The band fits snugly within deep grooves on the non-adjusting side. The grooves are shallow on the other side to allow the band to be more easily removed.

The mop head and flexible tubular band are both open on either end to allow the yarns to lay flat.

It is one purpose of this invention to provide a mop with a quick and easy replaceable mop heads. It is another purpose of the invention to provide for a mop with a head with replaceable rags and scrubbers.

It is another purpose to provide a rust proof or rust resistant (when plastics are used for the flexing portions) and durable mop handle with no moving parts that allows for replaceable mop heads.

It is another purpose to provide a hands free method to load or unload a mop head since it may pop in or out using the handle to grasp one end (the mop handle) and having the other end (the mop head) held in place by the user's foot.

It is another purpose to provide for a plastic band which is flexible to allow for wide spreading of the yarn to give a greater coverage per stroke and retention of the yarn's natural form.

Another purpose is provided by having the ends of the mop handle remain open to allow the yarns to act independently and flair better to lay flat on the cleaning surface.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DISCUSSION of the PREFERRED EMBODIMENT(S)

Figure 1:
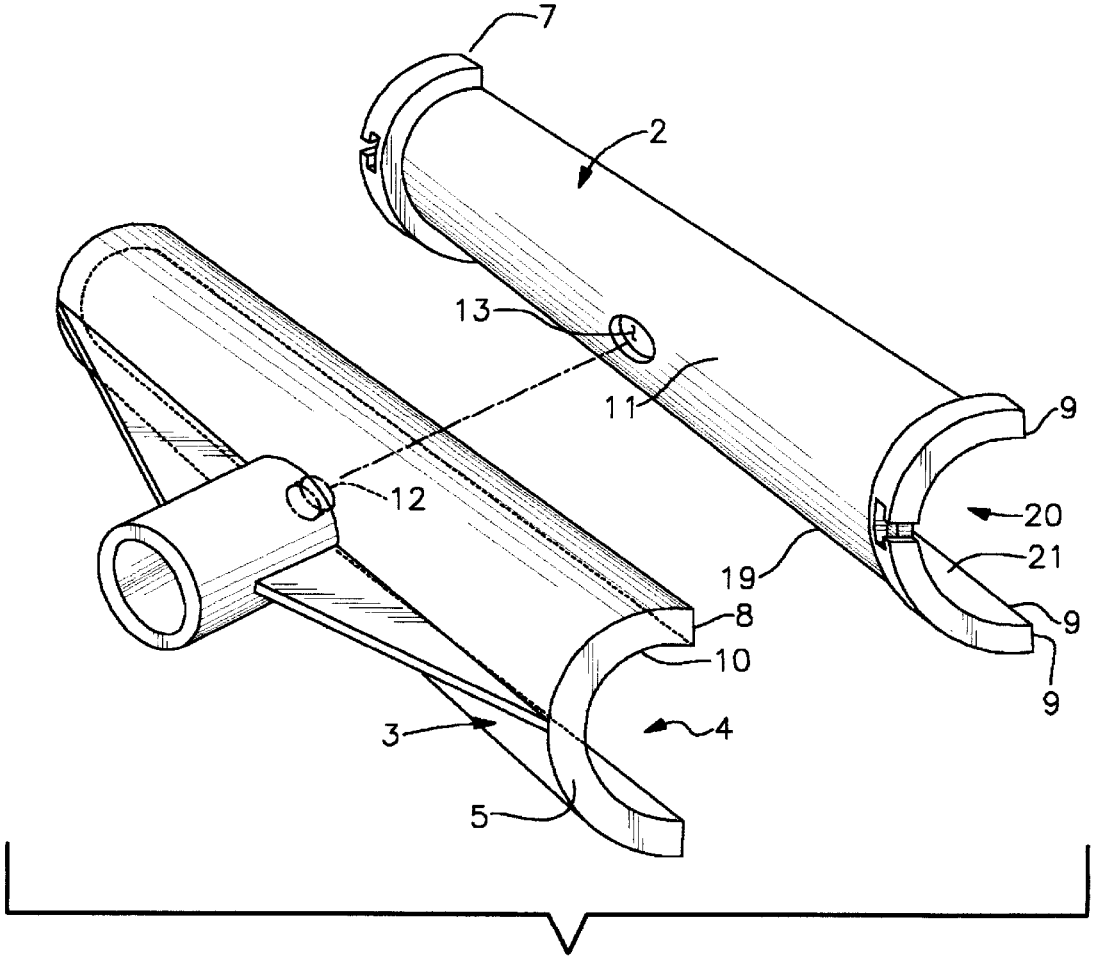
FIG. 1 is a plan view the invention.

As can best be seen by reference to FIG. 1, the invention comprises a mop handle 1 having a tubular band 3 which is preferably flexible for holding a mop head 2 which is preferably flexible. The mop handle 1 ends with the flexible tubular band 3. This tubular band has preferably two but at least one open end 4. In the preferred embodiment both ends 4 are open and have a flat outer surface 5. The invention further comprises a mop head 2 which is curved and is of slightly larger size than the size of the tubular band 3 so that when the mop head is placed within the tubular band either the tubular band flexes out, the mop head flexes in or both. The tubular band and is then held by the action of the tubular band or mop head attempting to go back to its pre-flexed position.

The mop head top surface 9 may be slightly lower than the top surface of the tubular band 8 so that the uppermost top surface 8 of the tubular band closes slightly over the mop head. This is not present in the preferred embodiment.

The mop head 2 has a ridge 6 which also has a flat inner surface 7 which fits against the outer surface 5 to prevent the mop head 2 from sliding within the mop handle 1. The flat surface 7 may be within the circumference of the mop head and contact a ridge which does not extend outside of the mop handle flexible tubular band to accomplish this same result.

In the preferred embodiment, the tubular band top surface 8 and mop head top surface 9 have an approximately equal surface. The curve 10 of the inner diameter of the mop handle and the curve 11 of the outer diameter of the mop head may be slightly greater from side to side than 270 degrees so that a slight curve inward on both is present.

A male member 12 and female member 13 are provided on the mop head and tubular band which cooperate to prevent, under ordinary forces, the mop head from rotating relative to the tubular band. The interaction of member 12 and 13 is not so strong as to prevent one to be forced to rotate relative to the other when the user twists one relative to the other.

Figure 2:
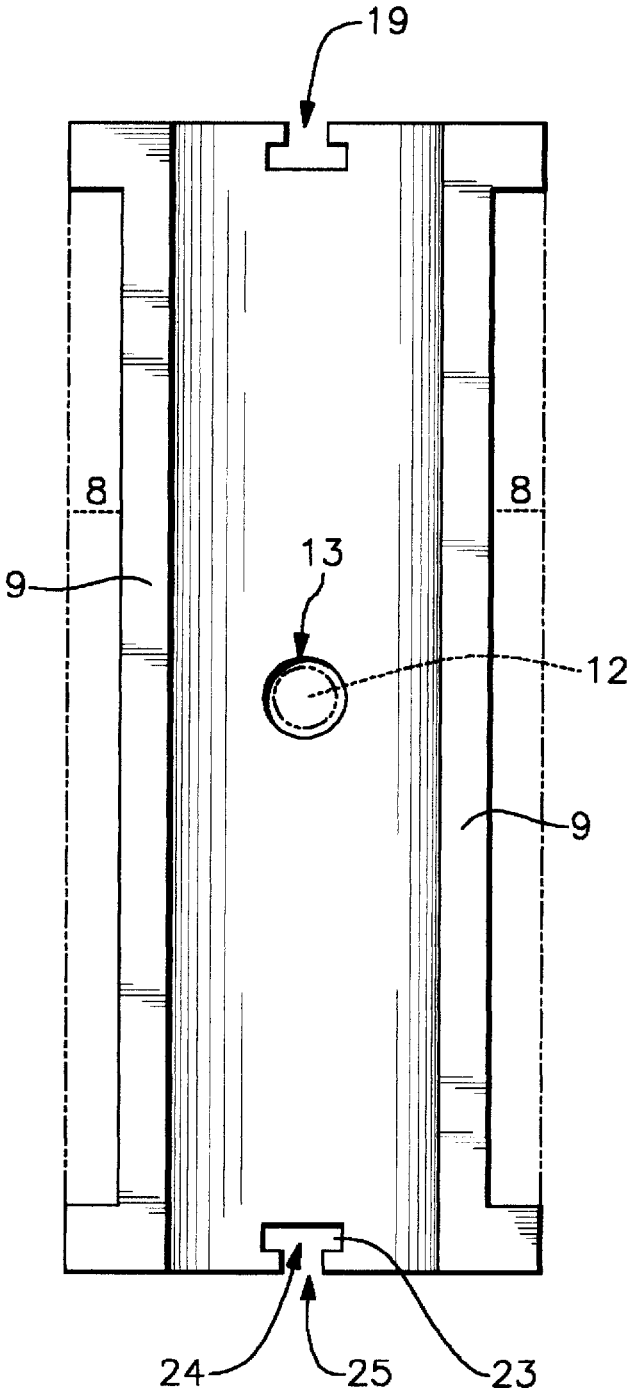
FIG. 2 is a view of the mop head showing the outer diameter 11.
Figure 3:
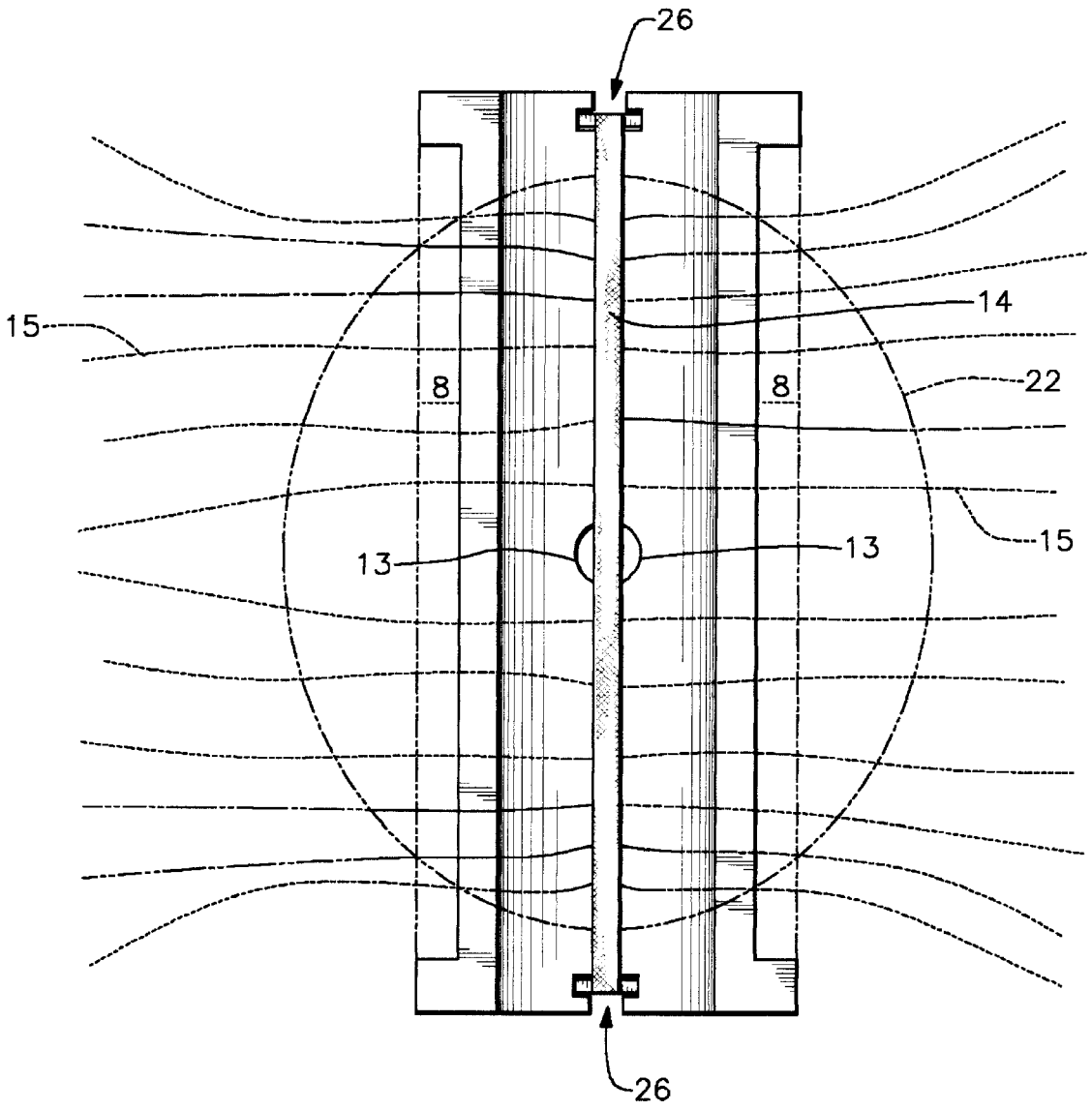
FIG. 3 shows the inner view of the mop head showing the inside 20.
Figure 4:
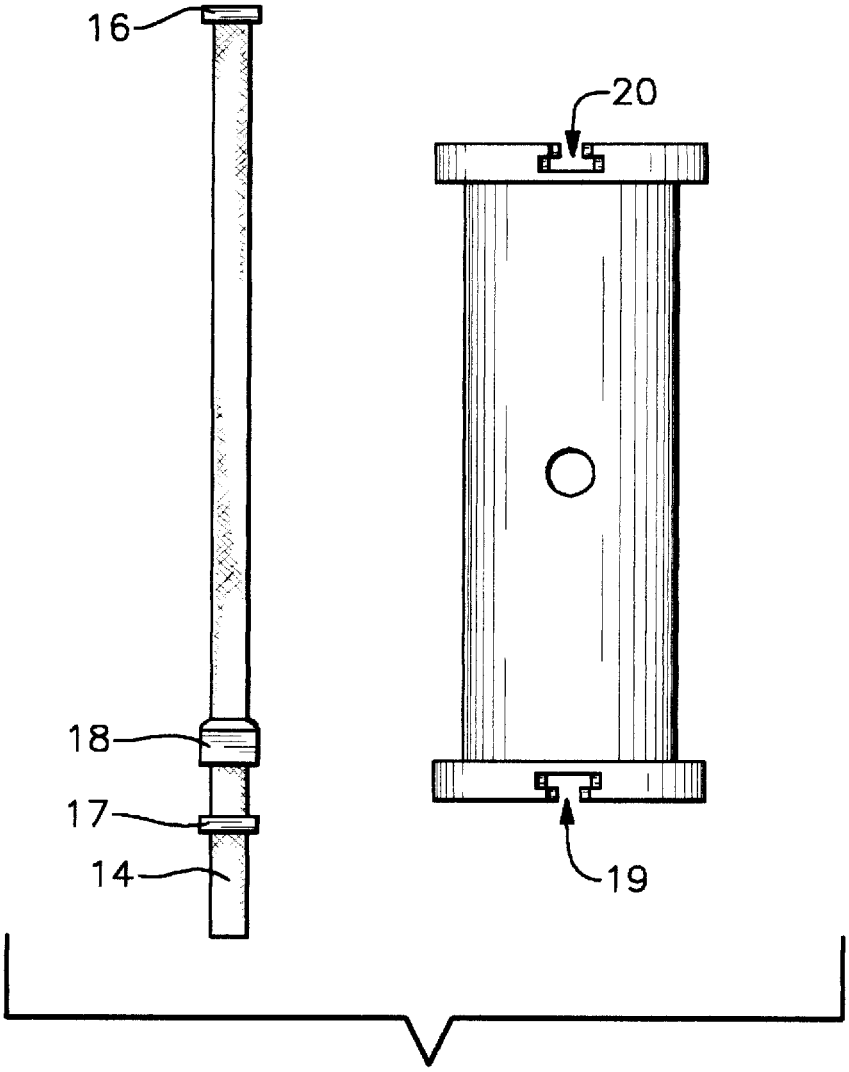
FIG. 4 shows a top plan view of the mop head with the band used to hold the yams.
Figure 5:
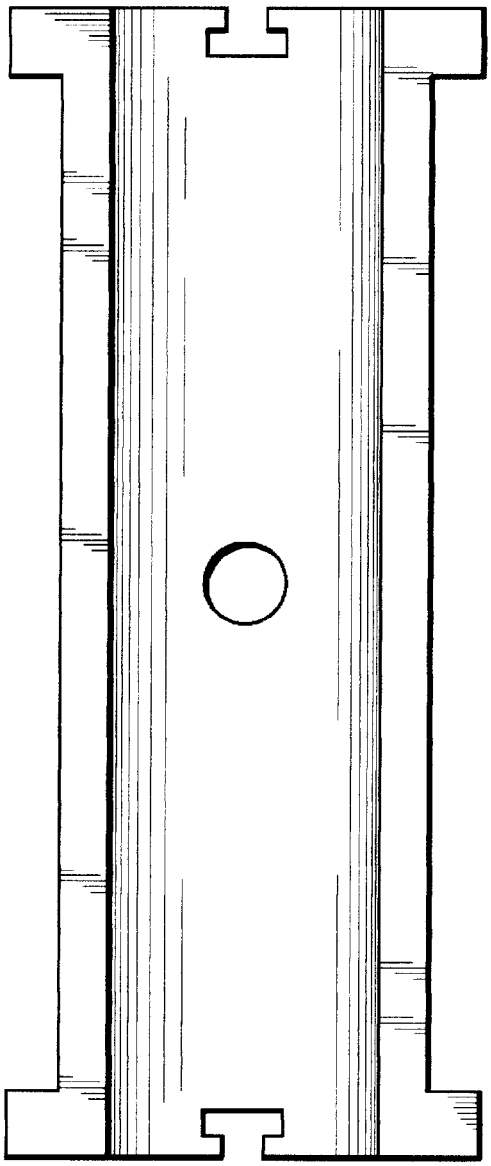
FIG. 5 shows a bottom plan view of the mop head.
Figure 7:
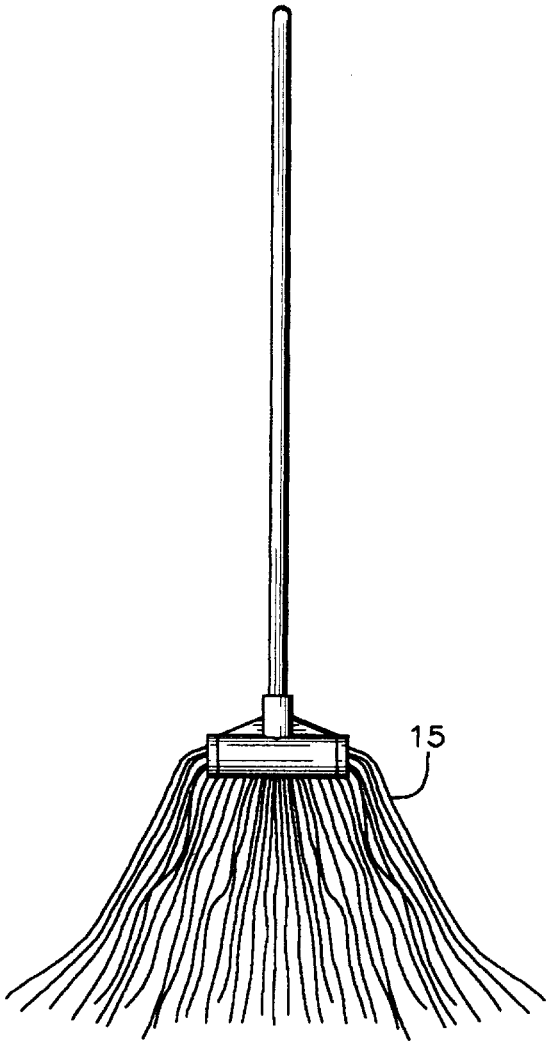
FIG. 6 and FIG. 7 show an assembled plan view.

As can best be seen by reference to FIGS. 2, 3 and 4, the mop head is otherwise improved in that it has a band 14 which holds the mop bristles or rags 15 in place. This band 14 has a left lock 16 and two right locks 17 and 18 on one side of differing lengths. A first right lock 17 is put in place in a groove 19 designed to receive the locks 17 or 18. This first lock is shorter and fits more loosely and is easier to remove therefore than the second right lock 18.

The mop head and flexible tubular band are both open on either end to allow the yarns to lay flat.

In use, the bristles or rags 15 are laid into the gap 20 provided between straight walls 21 in the mop head 2. The rags 15 are then fixed in place using the first lock 17 and the left lock 16. The rags are then spread out more evenly and the band 14 is tightened using the second right lock 18.

The band 14 locks on either side using a grooves 19 of this type. An added improvement possible with this mechanism is the addition of a scrub brush 22 which is preferably outside of the mop bristles which is held by the same band 14 or by a separate band (not shown) provided for this purpose. The band or bands 14 fit snugly within deep grooves 19 on the non-adjusting left side. The grooves 19 are shallow on the other right side to allow the band right locks 17 and 18 to be more easily removed or adjusted.

The grooves 19 are more fully described as shown in FIG. 2 as having on the top (outer surface of the mop head) a chamber 24 having a floor 23 defining the depth of the chamber 24 and an opening 25 from which the band extends. As shown in FIG. 3, the chamber has an inner opening 26 to allow the band 14 to pass through the center of the mop head covering the mop bristles or rags 15.

The mop head 2 is curved on the outside 11 but has flat walls 21 on the inside. These flat inner walls 21 allow the yarns of the mop to be inserted more easily. The sides 21 need only be flat, the bottom may be curved to reduce the amount of plastic used.

Figure 6:
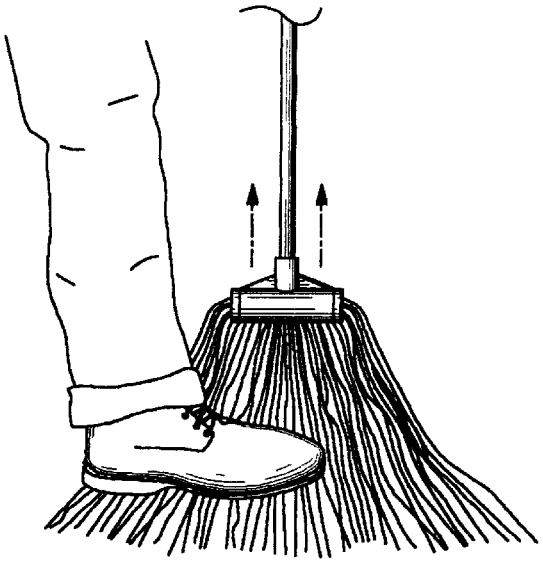

The mop handle as disclosed is fast and safe to change since the mop threads and mop head need not be touched with the hand. The users need only apply his feet to the mop threads as shown in FIG. 6 and pull up on the mop handle. Another mop head may then be snapped in place.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What I claim is:

1. A mop comprising:

an elongated mop handle having a U-shaped band of resilient flexible material secured to an end thereof, said band defining a longitudinal slot having an inner curve passing through the longitudinal axis of said mop handle, said band having a left outside curved surface and a right outside curved surface, said left and right outside curved surfaces each defining a diameter thereof, said outside surfaces are adjacent to and outside of the longitudinal slot and substantially flat;

an elongated, U-shaped mop head of approximately equal length to said band and defining an outer curve complimentary to the inner curve of the band so as to fit tightly within said band and be secured thereto within said longitudinal slot by interference fit, said mop head having cleaning means secured thereto;

and wherein said mop head further comprises a right ridge on a right side of the mop head and a left ridge on a left side of the mop head so that the left and right ridges are outside of the longitudinal slot when the mop head is inserted within the band, each said ridge having a diameter greater than the diameter of a respective outside surface so that the right ridge contacts the right outside surface and the left ridge contacts the left outside surface when the mop head is inserted within the band, said ridges preventing longitudinal movement of the mop head within the band.

2. The mop of claim 1 wherein the inner curve may move against outer curve to aid in the alignment of the mop head relative to the band when the mop head is inserted into the longitudinal slot.

3. The mop of claim 2 wherein the inner curve of the band is greater than 270 degrees so that at least a portion of the outer curve of the mop head is held within the inner curve of the band.

4. The mop of claim 1 wherein said gap is defined by said mop head substantially along the entire longitudinal length thereof.

5. The mop of claim 4 wherein the mop head is made of flexible material so that the mop head may flex when the mop head is inserted within the band.

6. The mop of claim 4 wherein the left ridge and right ridge further comprise a left groove and right groove respectively and further comprising an adjusting flexible band means having a left insertion means and a right insertion means inserted into the left and right insertion slots respectively.

7. The mop of claim 6 wherein said cleaning means further comprises yarn material fitting within the gap of said mop head and lying between said adjusting flexible band and said mop head.

8. The mop of claim 7 further comprising a scrub means having an abrasive surface having greater abrasive qualities than said yarn material fitting adjacent to said yarn material and between said adjusting flexible band and said mop head.

9. The mop of claim 8 wherein said scrub means has a length and said yarn material has a length and wherein the length of the scrub material is less than said yarn means length.

10. The mop of claim 1 further comprising a cooperating male and female means located respectively on the mop head and the band for preventing rotation of the mop head within the band.

11. The mop of claim 10 wherein the male means further comprises a male end on the inner curve of the band and a female end for receiving the male end on the outer curve of the mop head.

12. The mop of claim 1 wherein the band is flexible so that the band flexes outward when the mop head is inserted into the band so that the mop head is gripped by the band.

13. The mop of claim 12 wherein the mop head is flexible.

* * * * *